US005100002A

United States Patent [19]

Garran

[11] Patent Number: 5,100,002

[45] Date of Patent: Mar. 31, 1992

[54] KIT FOR DECORATED WISHING WELL

[75] Inventor: Joseph F. Garran, Strongsville, Ohio

[73] Assignee: Vanguard Marketing, Northfield, Ohio

[21] Appl. No.: 619,109

[22] Filed: Nov. 28, 1990

[51] Int. Cl.[5] ..... B65D 65/00

[52] U.S. Cl. ..... 206/577; 206/223; 206/457; 206/813; 229/923; D9/307; D9/322

[58] Field of Search ..... 206/457, 813, 223, 575, 206/577; 229/922, 923; D9/307, 311, 313, 322; D11/131, 157, 160, 164, 184; D25/22, 7; D99/41, 35-38

[56] References Cited

U.S. PATENT DOCUMENTS

| | | | |
|---|---|---|---|
| D. 284,313 | 6/1986 | Sidney | D11/157 |
| D. 293,304 | 12/1987 | Weder et al. | D11/164 |
| D. 305,979 | 2/1990 | Parker | D9/322 |
| 1,942,673 | 1/1934 | Weiner | 206/577 |
| 5,029,701 | 7/1991 | Roth et al. | 206/223 |
| 5,038,933 | 8/1991 | Weder | 206/813 |

*Primary Examiner*—William I. Price
*Attorney, Agent, or Firm*—Oldham, Oldham & Wilson

[57] ABSTRACT

Kit for forming decorated gift receptacle having the appearance of a wishing well, and decorated gift receptacle assembled therefrom. The wishing well comprises a bottom, four upright sides, each of which has a wide opening flanked by two upright pillars in the upper portion thereof, and pitched roof. Two of the sides have gables. The wishing well also has a slotted horizontal platform, just below the openings in the sides, for deposit of money, checks and envelopes. All visible of the surfaces of the gift receptacle are lace covered. The lace covering comprises a first set of overlapping horizontal lace ruffles covering the sides below the openings, a second set of overlapping horizontal lace ruffles covering the roof sections and the gables, vertical lace strips covering the pillars, and lace strips covering the top surface of the platform. The kit comprises an envelope containing therein a blank of stiff sheet material, which, when folded along fold lines therein, forms the bottom, the sides and the roof sections of the wishing well; a slotted rectangular piece of sheet material which forms the platform; and a stripe or ruffle of stretch lace which is long enough to cover the entire visible surface of the wishing well. The lace stripe preferably has scalloped edges and comprises a closely woven off center flat longitudinal stripe of closely woven cloth and a pair of ruffled lacy portions of unequal widths on either side of this stripe. The lace strip is cut into required length, each of which is affixed to a surface of the wishing well by means of a hot melt adhesive.

16 Claims, 5 Drawing Sheets

KIT FOR DECORATED WISHING WELL

TECHNICAL FIELD

This invention relates to receptacles for cash, checks, greeting cards and the like and more particularly to a decorated receptacle of this type and a kit which contains the necessary materials and instructions for assembly of such a receptacle.

BACKGROUND ART

Wedding guests and guests at certain other festive occasions such as bridal showers, baby showers, anniversary parties, graduations and retirement parties will usually give a gift to the person or persons being honored. While tangible gifts are frequently given on such occasions, in many cases both the giver of gift and the person(s) receiving the gift would prefer a cash gift. Frequently a giver does not know what present the would-be recipient would like to receive, and the recipient frequently prefers the freedom of selection which is afforded by a cash gift. As a result, cash gifts, whether in the form of actual cash, a check, or a gift certificate are frequently given on festive occasions such as those mentioned above. Sometimes a large bowl for receipt of such gifts is provided, but more often such gifts are merely placed on a table which invites a risk that some of the gifts will be accidentally lost.

While a plain undecorated gift receptacle for the receipt of cash gifts and the like is known and has been provided in kit form, such receptacle is rather plain in appearance and lacks a festive look which would be desired on a festive occasion. Such receptacle in assembled form is shown in FIG. 8.

DISCLOSURE OF THE INVENTION

This invention provides a kit for assembly into a decorated gift receptacle for special occasions. This kit comprises:

(a) a flexible waterproof container;

(b) a blank of sheet material having fold lines thereon, said blank when folded along said fold lines forming a gift receptacle comprising a bottom and a plurality of sides and being adapted to receive money, checks, greeting cards and the like; and (c) decorative trim attachable to the exterior surfaces of said blank after it has been folded to form said receptacle.

Lace ruffles constitute the preferred decorative trim material. Other decorative material in the form of a ruffle or strip can also be used for decoration. The decorative trim material in the kit is preferably separate from the blank of sheet material, and is attached during assembly.

This invention according to another aspect provides an assembled decorated gift receptacle or wishing well in which the lace ruffle or other ruffle or strip material is arranged in rows on the exterior surfaces (e.g., the sides) of the assembled gift receptacle. The assembled decorated gift receptacle comprises:

a bottom, a plurality of upright sides, and a roof formed of stiff sheet material which is foldable along fold lines therein, at least one of said sides having an opening in the upper portion thereof;

a horizontal slotted platform disposed below said opening; said bottom, said platform and said lower portions of said sides enclosing a space for receiving envelopes, checks, money and the like; and a plurality of overlapping strips of flexible decorative material affixed in parallel relationship to the exterior surfaces of said sides.

BEST MODE FOR CARRYING OUT THE INVENTION

This invention will now be described in detail with particular reference to the best mode and preferred embodiment thereof.

Figure 1:
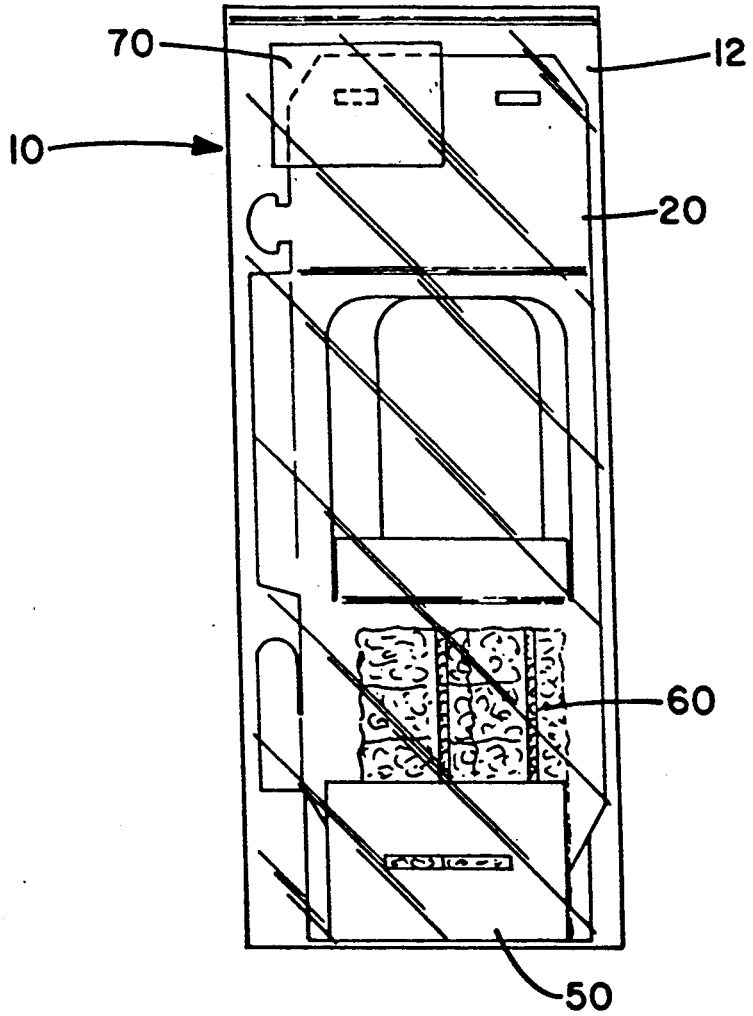
FIG. 1 is a front elevational view of a kit according to this invention.

Referring now to FIG. 1, 10 is a kit according to this invention. Kit 10 comprises a flexible transparent waterproof plastic container 12, made of plastic sheet (e.g., polyvinyl chloride or PVC) and in the form of a sealed rectangular bag or envelope. The container 12 contains all of the parts, other than adhesive, which form part of the assembled gift receptacle or wishing well of this invention.

The container or bag 12 may be formed by conventional means, e.g., by folding a rectangular plastic sheet along the transverse center line and sealing along the other three edges by stretching or heat sealing after all of the contents have been placed inside.

Inside container 12 is a blank 20 of stiff sheet material. The blank is made of an inexpensive rigid or semi-rigid material having two opposed flat surfaces or sides. Corrugated cardboard is preferred. (A semi-rigid material, as the term is used herein, denotes a material which is stiff enough to be self supporting in the upright position, so that the upright sidewall of the assembled gift receptacle will stand without sagging). The corrugated cardboard may be conventional, comprising a thin flat cardboard face sheet or layer which provides a first or front surface, a middle layer having parallel corrugations, and a thin flat cardboard back sheet or layer which provides a second or back surface. The front surface is preferably coated with a suitable pigment so that is white; the back surface is preferably uncoated and brown.

Figure 2:
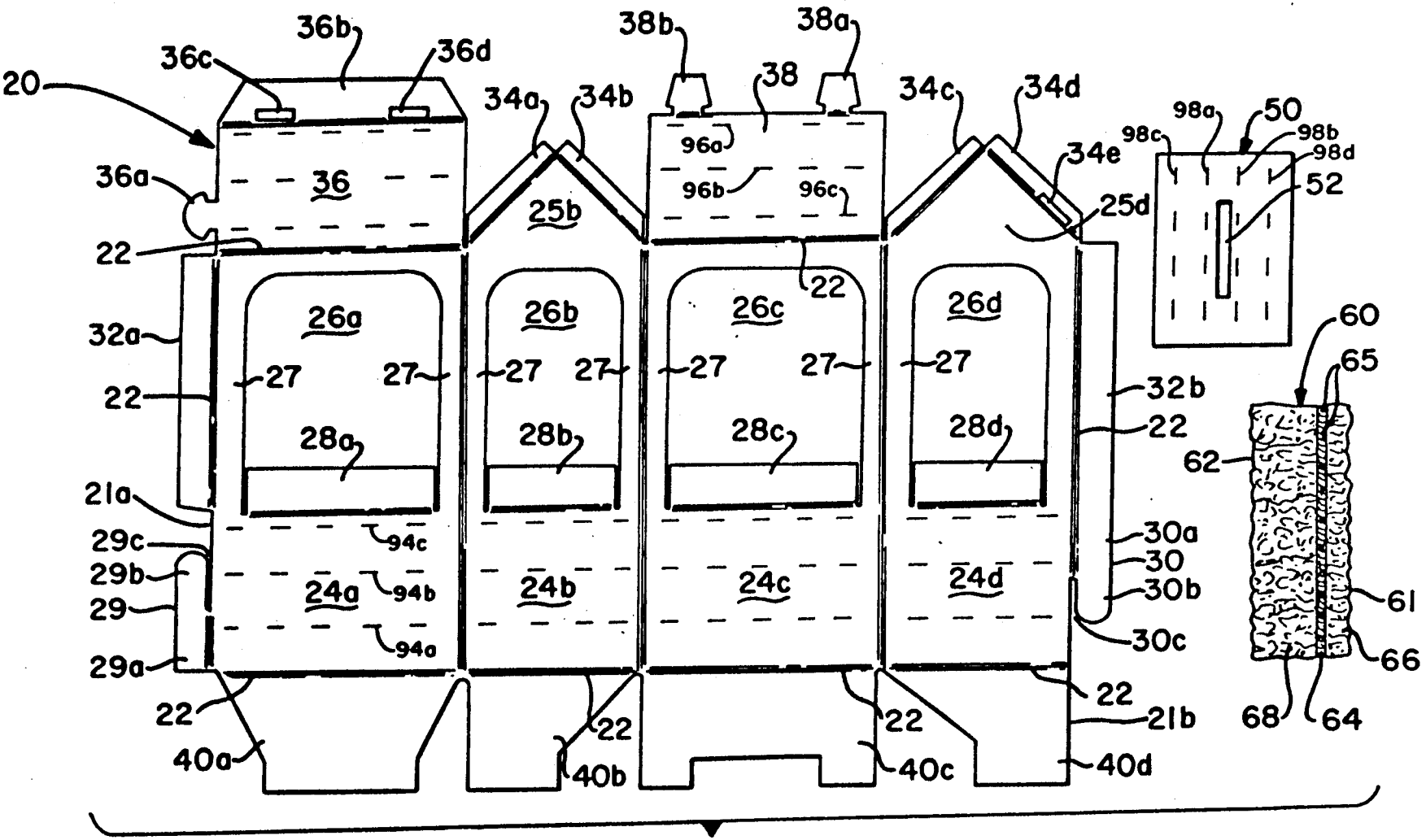
FIG. 2 is a plan view of a blank, a platform member and a lace ruffle used in forming a gift receptacle according to this invention.
Figure 4:
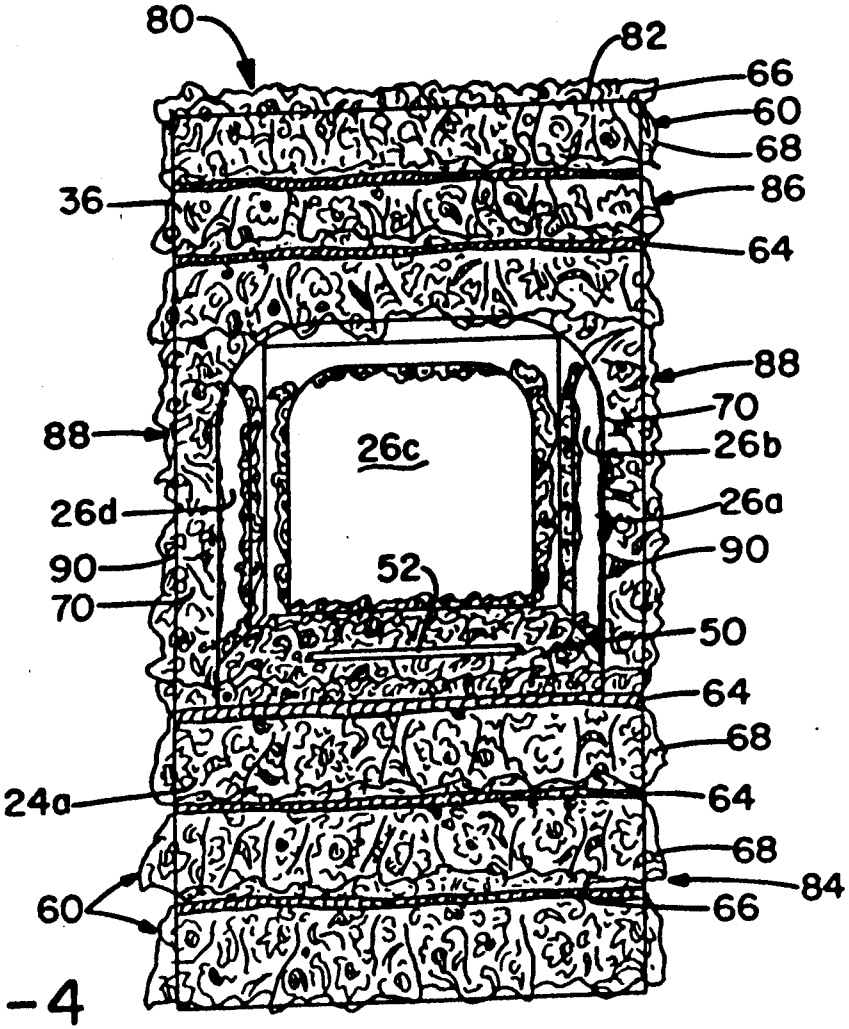
FIG. 4 is a front elevational view of the assembled receptacle according to this invention.
Figure 3:
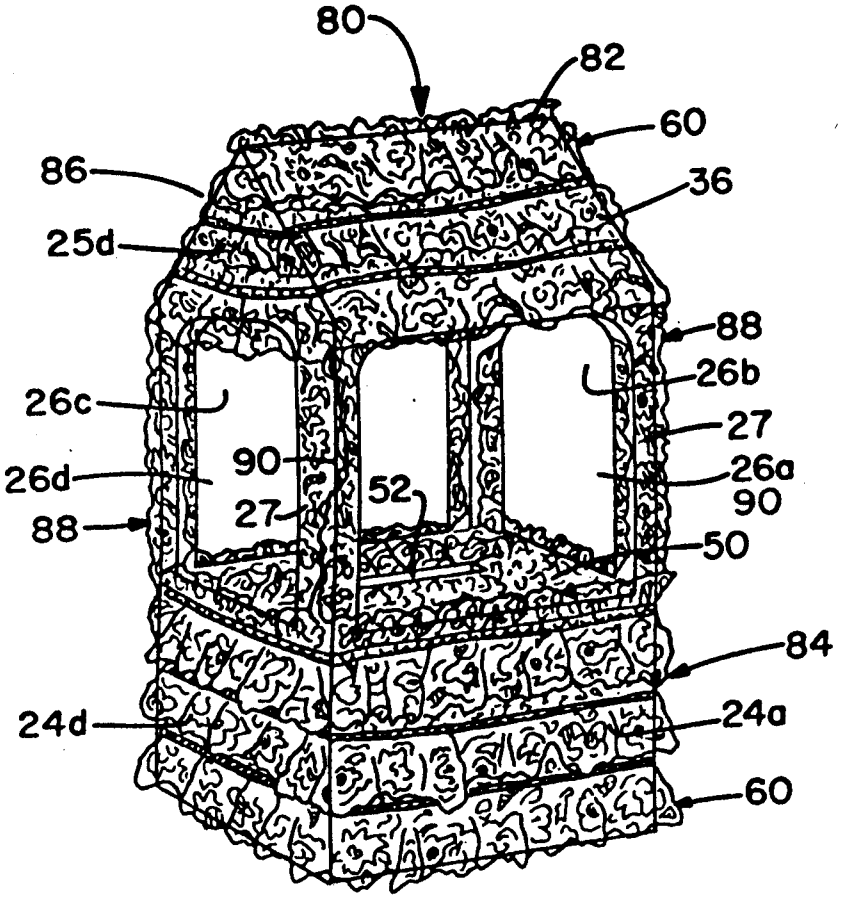
FIG. 3 is a perspective view of the assembled gift receptacle of this invention.
Figure 6:
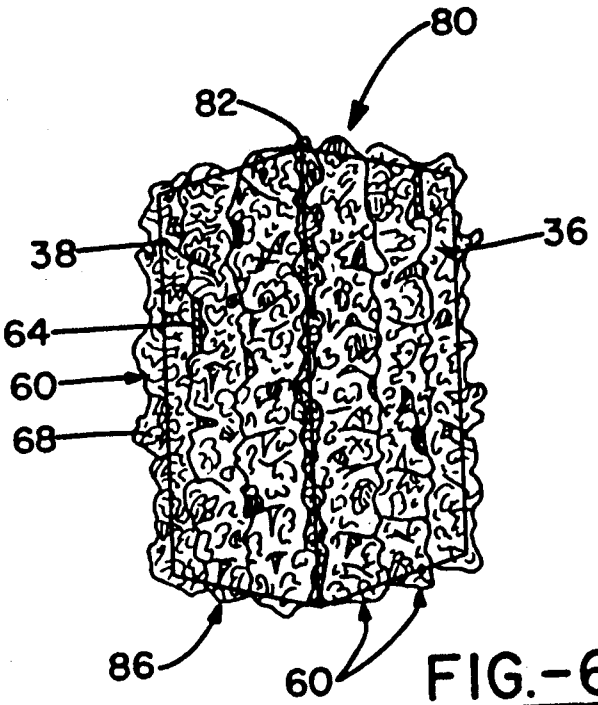
FIG. 6 is a top view of the assembled receptacle of this invention.
Figure 5:
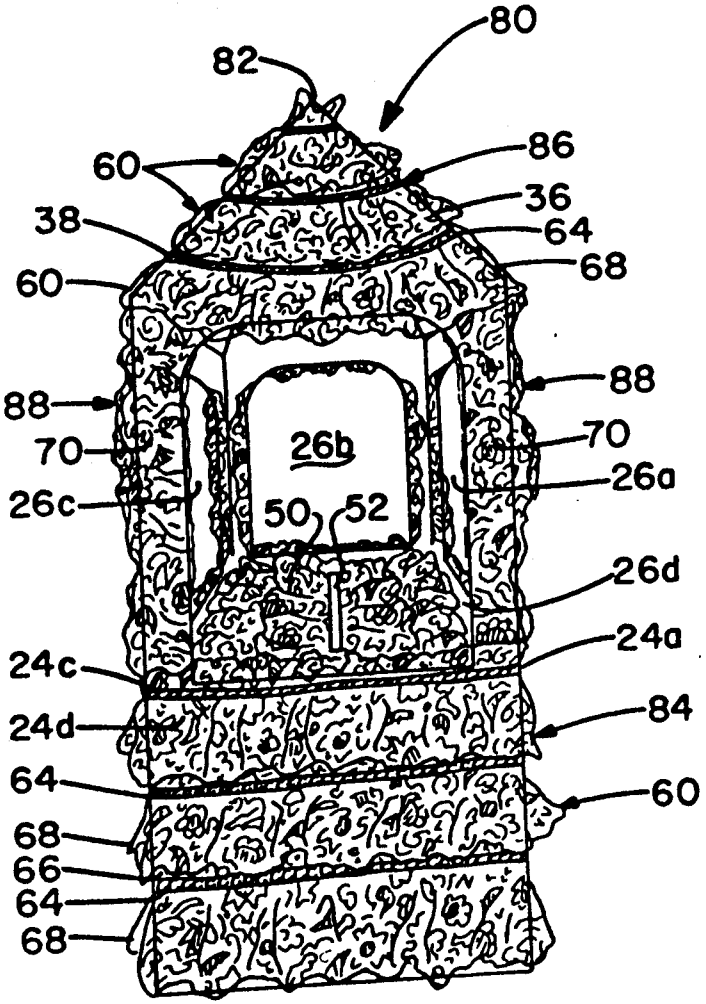
FIG. 5 is a side view of the assembled wishing well of this invention.

FIG. 2 shows blank 20 in detail, with the back surface (or second surface) facing up. Blank 20 has a pair of sides and a plurality of fold lines 22 which divide the blank into a plurality of sections including panels 24*a*, 24*b*, 24*c* and 24*d* in side-by-side relationship, and a number of flaps as will be hereinafter described. The panels 24*a*, 24*b*, 24*c* and 24*d* form the vertical sides of the assembled gift receptacle of this invention. Since the assembled gift receptacle must have at least three (3) sides and preferably has four (4) sides and is of rectangular cross-sectional shape, the blank 20 must have at least three (3) panels and preferably has four (4) panels in side-by-side relationship. Panels 24*a* and 24*c*, which form one (1) pair of opposite sides (i.e., the front and back) of the assembled gift receptacle, are rectangular and are of the same width and height. The other pair of panels 24*b*, 24*d* forming the other pair of opposite sides (i.e., the right and left sides) of the gift receptacle, are five-sided in shape, having gabled top ends 25*b* and 25*d*, respectively, and are narrower than sides 24*a* and 24*c*. By way of example, panel 24*b* has two (2) parallel upright edges 22, which form the boundaries with panel 24*a* and 24*c*, respectively, a lower edge 22 which is perpendicular to these two edges, and two diagonal upper edges (which are also fold lines 22) of equal length and forming equal obtuse angles with respective vertical edges 22 which they intersect. Panel 24*d* has the same size and shape as panel 24*b*.

The two outside panels 24*a*, 24*d* are disposed along the left and right edges, respectively, of the blank 20 but are adjacent to each other in the assembled gift receptacle as will be apparent in FIGS. 3–8.

It should be noted that all folds on the second (or brown) side, which is the side visible in FIG. 2, are inward. Conversely, all folds on the first (or white) side, which is the side visible after assembly, fold outward.

Panels 24*a*, 24*b*, 24*c* and 24*d* have cutout portions which form openings or windows 26*a*, 26*b*, 26*c*, 26*d*, respectively. These openings are only slightly less wide than the respective panels. These openings are disposed in the upper portion (roughly the upper half) of each panel. These openings are essentially rectangular in shape but may have rounded upper corners as shown. The side edges of openings 26*a*–26*d* are parallel to and spaced from the adjacent fold lines 22. This provides a pair of comparatively narrow pillars or columns 27 on each side of each of the panels 24*a*, 24*b*, 24*c* and 24*d*. All of these columns are preferably of equal width. The upper edges of openings 26*a* and 26*c* are parallel to and spaced from the respective upper fold lines of panels 24*a* and 24*c*. All four openings 26*a*–26*d* have the same height. Rectangular turn-down flaps 28*a*, 28*b*, 28*c* and 28*d* are disposed at the bottoms of the respective openings 26*a*–26*d*. These flaps 28*a*–28*d*, when turned down, form support ledges for a platform to be described later. Openings 26*a*–26*d* form open windows for the gift receptacle or wishing well 10 so that a donor can reach in and deposit his or her gift.

Body locks 29, 30 are attached to the outer edges of panels 24*a*, 24*d*, respectively by fold lines. These body locks 29, 30 are attached to the lower portions of panels 24*a*, 24*d*, below the openings 26*a*, 26*d*. These body locks include respective body portions 29*a*, 30*a* which are attached to the respective panels 24*a*, 24*c* via the aforesaid fold lines, and finger-like portions 29*b*, 30*b*, extending therefrom and separated from the adjacent panels 24*a*, 24*d*, respectively, by slots 29*c*, 30*c*, respectively. It will be noted that the finger-like portion 29*b* of body lock 29 points up while the finger-like portion 30*b* of body lock 30 points down, to provide locking engagement between these two body locks when the blank 20 is folded into a rectangular prism to form the wishing well.

Also disposed along the outside edges of panels 24*a*, 24*d*, alongside and above openings 26*a* and 26*d*, are long narrow side flaps 32*a*, 32*b*, respectively. These side flaps engage panels 24*d* and 24*a* (specifically pillars 27 thereof), respectively, in the assembled wishing well.

Body locks 29, 30 and the long narrow side flaps 32*a*, 32*b* together form flap means for the curing together the two outside panels 24*a*, 24*d* so that these panels form adjacent vertical sides with a right angle there between in the assembled gift receptacle.

Gable end flaps 34*a*, 34*b* are attached by fold lines 22 to the gabled top end 25*b* of panel 24*b*. Similarly, gable end flaps 34*c*, 34*d* are attached by fold lines 22 to the gable top end 25*d* of panel 24*d*. A slot 34*e* is formed in flap 34*d* along the fold line for receipt of a tongue-like lock as will be hereinafter described.

A rectangular roof flap 36 is attached to the top edge of panel 24*a* by a fold line 22, along the outside edge of flap 36 is a tongue-like lock 36*a*, which is received in slot 34*e*. Along the upper edge of roof flap 36*a* is a comparatively narrow, laterally extending extension flap 36*b* which extends the entire width of flap 36. Slots 36*c*, 36*d* are formed in extension 36*b* along the fold line 22 which joins extension flap 36*d* to roof flap 36.

A second roof flap 38 is joined to the upper edge of panel 24*c* via fold line 22. Along the upper edge of flap 38 are a pair of tongue-like locks 38*a*, 38*b* which are received in the respective slots 36*c*, 36*d*.

A tongue flap 40*a*, a first angle flap 40*b*, a notched flap 40*c*, and a second angle flap 40*d* are joined to the bottom edges of panels 24*a*, 24*b*, 24*c*, and 24*d*, respectively, along fold lines 22. It will be noted that angle flaps 40*b*, 40*d* are angled in opposite directions. There is a cut out portion between each of these flaps 40*b*, 40*d* and flap 40*c*. Bottom flaps 40*a*, 40*d* form the bottom of the assembled wishing well 10.

A rectangular cardboard sheet 50, having a longitudinal slot 52 along the longitudinal center axis is also inside the flexible plastic container or envelope 12. This rectangular sheet 50 is preferably (and usually) formed of the same material as blank 20. Sheet 50 forms a horizontal platform in the assembled wishing well 10, and slot 52 permits the deposit of envelopes or checks into the concealed interior space of the assembled wishing well.

A long ruffle or strip 60 of decorative lace, preferably white and preferably stretch lace, is also inside the envelope 12. This decorative lace strip 60 is of sufficient length to decorate the entire exterior surface of the assembled wishing well, as will be described. Also as will be described, pieces of appropriate size are cut from this strip for decoration. The lace ruffle or strip 60 is preferably rolled around a flat core of cardboard, sheet plastic or the like.

FIG. 2 illustrates lace ruffle 60, which is preferably of stretch lace, in detail. Referring to FIG. 2, lace ruffle 60 is in the form of a longitudinally extending strip having longitudinally extending side edges 61 and 62, which are preferably scalloped, although straight edges are acceptable. The lace strip 60 has a longitudinally extending stripe 64 of flat, closely woven cloth which may have decorative eyelets 65 at regular intervals along the longitudinal center line of strip 64. On either side of stripe 64 are ruffled lacy portions 66 and 68, which preferably are of unequal width, the portion 68 being the wider. Provision of the narrow, comparatively dense and closely woven stripe 64 is highly desirable not only for decorative purposes but also in order to provide a line of attachment for attaching the lace strip 60 to the exterior surfaces of the wishing well. The lace ruffle 60 may be made of any suitable cloth material, such as cotton, polyester or a blend of the two, preferably with a small amount of a fiber which imparts stretchiness, such as spandex.

The width of lace ruffle 60 should be in proportion to the dimensions of the assembled gift receptacle. The preferred dimensions of the gift receptacle will be discussed with greater detail with reference to FIGS. 3–8. For a gift receptacle of preferred dimensions as will be discussed hereinafter, the ruffle 60 is normally about 3 to about 6 inches wide, preferably about 4 to about 4½ inches wide.

Finally, the flexible envelope 12 contains a printed instruction sheet, brochure, pamphlet or booklet 70 (FIG. 1) containing instructions on how to assemble the gift receptacle 10.

FIG. 2 shows all of the contents of envelope 12 except instruction sheet or brochure 70.

Figure 7:
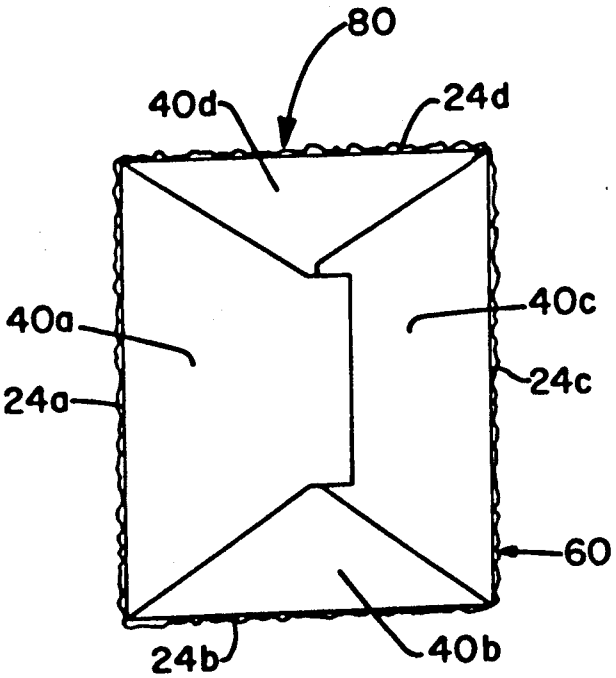
FIG. 7 is a bottom view of the assembled receptacle of this invention.

The assembled wishing well 80 according to this invention is shown in FIGS. 3–7. Referring now to FIGS. 3–7, the assembled and decorated wishing well 80 is of rectangular cross section and comprises upright exterior walls 24*a*–24*d*, i.e., an upright front 24*a*, an upright back 24*c* which is parallel to front 24*a*, and upright sides 24*b* and 24*d* which are perpendicular to front 24*a* and back 24*c*. Sides 24*b*, 24*d* have gables 25*b*, 25*d*, respectively at their upper ends. The assembled wishing well 80 comprises a roof having a pair of sloping sections 36, 38 which intersect each other along a horizontal peak 82. Walls 24*a*–24*d* have openings 26*a*–26*d*, respectively, therein. These openings form open windows which permit persons to reach into the interior of the assembled wishing well. Just below openings 26*a*–26*d*, and coplanar with the lower edges thereof, is a horizontal rectangular platform 50 having a slot 52 therein. The space below platform 50 is concealed from view and serves as a receptacle for money, checks, envelopes and the like. The bottom of the assembled and decorated wishing well 80, which is formed by flaps 40*a*–40*d*, is shown in FIG. 7.

The entire exterior surface of the assembled wishing well is covered with strips of lace 60. The interior surfaces of the pillars 27, which are visible to an observer, are also lace-covered. In short, all surfaces which are visible to an observer when the wishing well is standing in its normal upright position are lace covered. The upper surface of platform 50 is also lace covered.

The bottom or lower portion of the decorated wishing well 80, below the openings 26*a*–26*d*, has a first set or course 84 of horizontally extending ruffles 60 which are arranged in overlapping, vertically displaced rows. Three such rows are shown and this is the preferred number for aesthetic purposes. Each row contains a single lace ruffle 60 which extends horizontally around the entire perimeter of the assembled and decorated wishing well 80. Each lace ruffle 60 is adhesively joined to the sides 24*a*–24*d* by means of a suitable adhesive, such as a hot melt adhesive, which is applied as a horizontally extending bead as will be hereinafter described. The closely woven portion 64 of each ruffle is applied to this adhesive. The ruffles are arranged in rows so that the lower edge of each ruffle is approximately coincident with or just above the woven strip 64 of the ruffle below. The lower edge of the lowest ruffle coincides approximately with the bottom edges of the sides 24*a*–24*d*. Consequently the wider ruffled portion 68 of each ruffle 60 is visible and the narrower ruffled portion 66 of each ruffle 60 (except the ruffle nearest to openings 26*a*–26*d*) is concealed. The lowest ruffle should be set low enough so that it completely covers the sides.

A second set of ruffles 86, disposed in the upper portion of the gift receptacle 80, i.e.,above openings 26*a*–26*d*, covers both roof sections 36, 38 and the gables 25*b*, 25*d*. Each of the ruffles in this set also extends horizontally around the entire perimeter, i.e., across one roof section 36, a first gable 25*b*, the other roof section 38, and across second gable 25*d* back to the place of the beginning. These ruffles are also adhesively secured along their closely woven portions 64 as will be described below.

A vertically extending set of ruffles 88 covers both the inside and outside surfaces of pillars 27. Pillars 27 and openings 26*a*–26*d* form the mid-portion of the gift receptacle 80).These ruffles are applied so that the closely woven stripes 64 are set close to the corners 90 (i.e., the intersections of two adjacent columns 27). The wider lace portions of the ruffles are wide enough so that each covers both the outside and the inside surface of a given pillar 27.

Finally, the upper surface of platform 50 is covered with longitudinally extending ruffles 60, i.e., ruffles that extend in the same direction as the slot 52. These ruffles are also arranged in overlapping relationship.

Figure 8:
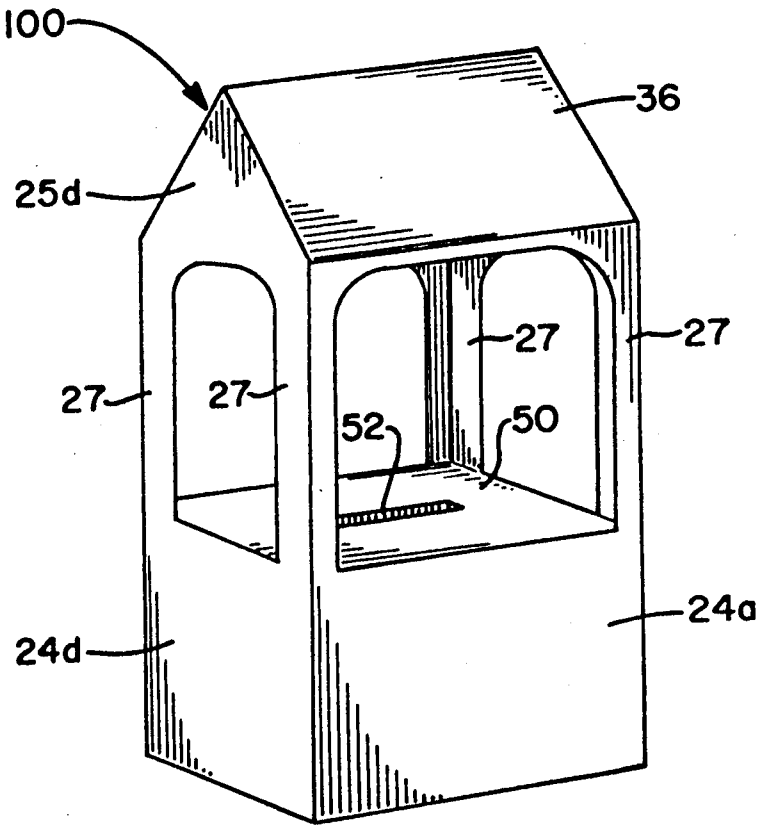
Prior Art FIG.-8
FIG. 8 is a perspective view of an undecorated receptacle.

An assembled but undecorated gift receptacle 100 (with platform 50 in place) is shown in FIG. 8. Undecorated gift receptacles similar to that shown in FIG. 8 were previously known and sold in kit form. Those kits contained a blank similar to blank 20 herein but lacked any decorative lace.

Application of decorative lace to the undecorated gift receptacle as shown in FIG. 8 will now be described.

The gift receptacle of this invention may be made of any desired dimensions. Representative and preferred dimensions are as follows:

| | |
|---|---|
| width | 15" |
| depth | 12" |
| height (base to roof peak) | 29" |
| height (base to lower edge of roof) | 23" |
| height of openings 26a–26d | 12" |
| width of openings 26a–26d | 9" |
| height of platform 50 above base | 10" |
| width of pillars 27 | 1.5" |

A representative and preferred lace strip 60 has the following dimensions:

| | |
|---|---|
| length | at least 437" |
| width (max) | about 4¼" |
| edges | scalloped |
| width of dense strip | ⅜" |
| width of first (narrower) lacy portion | 1" |
| width of second (wider) portion | 2⅝" |

The length given above is the minimum, and does not allow for any errors in cutting. In practice a slightly greater length about 40 feet (480 inches) is desirable.

The wishing well 10 is assembled as follows:

First one removes blank 20 from the envelope 12, unfolds it, and lays it flat, second (brown) side up as shown in FIG. 2, on a clean, flat, horizontal surface such as a floor or a table top.

One then pre-breaks and fold inward all remaining flaps and locks, i.e., all which were not pre-broken and folded inward prior to insertion into envelope 12. All of the major body folds and bottom lock flaps (40*a*–40*d*)

have been pre-broken and folded inward. There are 16 such flaps and locks in all.

One "squares up" the wishing well 10, so that the outside edges of panels 24*a* and 24*d* coincide. Then one slides the first and second body locks 29, 30, respectively into the respective slots 29*c*, 30*c*.

The long narrow side flaps 32*a*, 32*b* are then folded inward. The gable end flaps 34*a*, 34*b*, and 34*c*, 34*d* are then folded in. Roof flap 36 is folded down over gable flaps 34*a*, 34*d* and side lock 36*a* is inserted into slot 34*e*. Roof flap 38 is folded down over gable end flaps 34*b*, 34*c*. The locks 38*a*, 38*b* on the second roof flap 38 are then inserted into the slots 36*c*, 36*d* on the first roof flap 36.

At the bottom of the wishing well 10, the notched flap 40*c* is folded up 90°. Then the two side flaps (or angle cut flaps) 40*b* and 40*d* are folded in 90°. They should "snap". The tongue flap 40*a* is then folded inwardly approximately 120°-150°, or until it locks in place as it goes past the other flaps 40*b*, 40*c* and 40*d*. The bottom of the receptacle (which is formed by the flaps 40*a*-40*d*) should appear caved in. Then one places the bottom on a flat surface and presses down from the inside to flatten out the bottom.

Finally one turns down the flaps 28*a*-28*d* at the mid-section of the wishing well 10. These flaps form ledges for platform 50.

One may place the undecorated platform 50 on the ledges formed by turndown flaps 28*a*-28*d* at this time if desired. This serves mainly to confirm that the platform 50 has been accurately cut to the correct size and that all corners 90 between adjacent panels or sides 24*a*-24*d* are true right angles. The platform is turned diagonally and inserted into the interior of the upright receptacle through one of the side openings 26*b*, 26*d*. With the white side up, one corner of the platform 50 is then eased downward until it touches a pair of adjacent ledges 28*a*-28*b*. The platform 50 is then eased into level position, resting on ledges 28*a*-28*d*, with the white (or first) side up. The undecorated platform 50 should fit somewhat snugly but loosely enough so that it can be inserted and removed without bending. If the platform 50 has been put in place, it is then removed so that both it and the upright gift receptacle can be decorated with lace.

Next, the locations for the beads of hot melt glue or adhesive (by means of which the lace ruffles 60 are applied to the exterior of the gift receptacle 80) must be marked on the exterior or white side of the gift receptacle. These locations are preferably marked with a pencil. They may be preprinted on the white side of blank 20 if desired. Also, the bead lines may be marked on the white side of blank 20 before assembly of the upright gift receptacle if desired.

First set of bead lines consist of three horizontal lines, 94*a*, 94*b* and 94*c*, uniformly spaced apart and extending horizontally around the entire perimeter of the gift receptacle on the lower portions of panels 24*a*-24*d* below the openings 26*a*-26*d*. The first and lowest bead line 94*a* is marked 2¾ inches above edges of panels 24*a*-24*d*. The second and third bead lines 94*b* is marked about 3 to 3½ inches above bead line. Similarly, the third bead line 94*c* is market about 3 to 3½ inches above bead line 94*b*. These distances are based on the preferred dimensions of the assembled gift receptacle 80 and the lace ruffles 60 previously given. In any case, the distance from the bottom edge of each panel 24*a*-24*d* to the first bead line 94*a* is about equal to or slightly less than the width of the wider lace ruffled portion 68 of lace ruffle 60. The distance between successive bead lines in the set 94*a*, 94*b* and 94*c* is slightly greater than the width of the wider portion 68 of the lace ruffle 60. Finally, the distance from the third or highest bead line 94*c* to the lower edges of openings 26*a*-26*d* must be less than the width of the narrower ruffled lace portion 66 of lace ruffle 60, so that the lace ruffles will completely cover the lower portions of the panels 24*a*-24*d*. It is sufficient to mark the locations of the bead lines only along the vertical edges of panels 24*a*-24*d* (i.e., at corners 90). It is not necessary to draw the bead lines in full.

The locations of bead lines 94*a*-94*c* are shown in dotted lines in FIG. 2. The bead lines are shown as dotted lines for clarity and because they are drawn on the white side of the gift receptacle, while the brown side of the blank 20 is shown in FIG. 2.

A second set of horizontal bead lines 96*a*, 96*b*, and 96*c* extends around the perimeter of the assembled gift receptacle 80 above the lower edges of roof sections 36, 38. These bead lines extend across the sections and gables 25*b*,25*d*. Bead lines 96*a*, 96*b*, and 96*c* are marked on the white sides of the roof sections 36, 38, either in full or (preferably) only along the vertical (or lateral) edges of the roof sections 36, 38. The locations of these bead lines are also shown as dotted lines in FIG. 2. The first and uppermost bead line 96*a* in this set is marked about ½ to about ¾ inch below the roof peak 82. The next two bead lines 96*b*, 96*c* are each marked about 3 to about 3½ inches below the preceding bead line. The distances given are based on the preferred dimensions of assembled gift receptacle 80 and lace ruffle 60 given earlier, and are such as assure that a portion of the topmost lace ruffle 60 will extend above the roof peak 82 and that a portion of the lowermost lace ruffle 60 in this set will extend below the intersections of roof section 36, 38 with respective side panels 24*b*, 24*d*. The specific distances will vary as the dimensions of the gift receptacle 80 and the lace ruffle 60 are varied, so that lace ruffle 60 will always completely cover the roof section 36, 38 and the gables 25*b*, 25*d* and will extend above the roof peak 82 and below the lower edges of roof sections 36, 38.

The lace is applied as follows:

Lace is applied first to the lower (or body) portions of panels 24*a*-24*d*, below openings 26*a*-26*d*. First, one cuts three (3) strips, each 54" long, from the roll. (This length is slightly less than the perimeter of a gift receptacle 70 having the preferred dimensions given above. Since stretch lace is preferably used, the lace will be stretched as subsequently described so that it extends around the entire perimeter). Then one lays three (3) beads of hot melt adhesive or glue along lines 94*a*, 94*b*, 94*c*, one bead at a time in that order and one panel at a time, starting at one corner 90 of the upright gift receptacle 80. Thus, one applies a horizontal bead of hot melt adhesive or glue along line 94*a* on any one of the panels 24*a*-24*d* (say panel 24*a*) from the left edge to the right edge, and then immediately affixes one of the precut lace ruffles 60 so that the relatively dense stripe 64 is placed on top of the adhesive bead, stretching the lace ruffle slightly in the longitudinal direction. This process in continued along line 94*a* around the entire perimeter of the gift receptacle 80. Then the lace ruffle must be stretched enough when as it is applied so that it will stretch around the entire perimeter. Then the process is repeated along bead line 94*b*, then along bead line 94*c*. The spacings are such that the lower edge of the lowest piece of lace lies substantially along the bottom edge of the wishing well, and so that the lower edges of the next two pieces of lace lies substantially along the dense strips of the respective pieces of lace just below. In this way the rows of lace overlap so that the narrower portion 64 of each piece of lace (except the piece which forms the top row) is covered by the lower portion of the lace forming the next higher row.

Next, lace is applied to the pillars 27. Eight 11" pieces of lace are cut from the roll. Beads of hot melt adhesive are laid down along the outside surfaces of the pillars 27 next to the right angle corners 90. Spots of hot melt adhesive are laid down on the inside surfaces of these pillars close to the right angle corners. Then the pieces of lace are applied to the outside surfaces of the pillars so that the closely woven stripes 64 are placed on the beads of hot melt adhesive. The narrow lace portions 64 protrude beyond the right angle corners. The wider portions 66 are folded around the inner edges of the pillars (where the pillars meet the openings 26*a*–26*d*) and are pressed against the spots or dots of hot melt adhesive on the inside surfaces of the pillars, this gives the pillars a finished look. Preferably the beads of hot melt glue are laid down and the pieces of lace applied one at a time until all 8 pieces have been applied.

The roof panels (or flaps) 36, 38 and the gable top ends 25*b*, 25*d* are then covered with lace as follows:

First a piece of lace 32" long is precut. A bead of hot melt glue is laid down on roof flap 36 or 38 along the first or top bead line 96*a* which is located about ½" to 1" below the edges forming the roof peak 82. The lace is then applied to the fresh bead of glue with slight stretching. The bead of glue is then extended horizontally across gable 25*b* or 25*d* to the bead line or mark on the other roof section 38 or 36. The lace is then applied with stretching to this fresh bead of glue. The same procedure of first applying a glue bead, then applying the lace, is repeated on the other roof section 38 or 36 and finally on the other gable 25*d* or 25*b*. This provides a glue bead and lace ruffle 60 extending horizontally around the entire perimeter of the sloping roof flaps 36, 38 and the gables 25*b*, 25*d*. The upper edge 61 and part of the narrow lace portion 66 of the ruffle 60 so applied will be above the roof peak 82. The wider portion 68 of the lace ruffle will extend downwardly from the glue bead.

Next, a piece of lace 42 inches long is precut. This lace ruffle is applied over a freshly laid horizontal bead of hot melt glue or adhesive in the same manner as described above. The location of the hot melt adhesive bead for the second lace ruffle 60 is denoted by marks or line 92*b*, location about 3 to 3½ inches below the first glue line 92*a* as measured along the roof sections. The third lace ruffle 60, 53 inches long, is precut and applied along freshly laid bead of glue, laid down along a horizontal line 92*c*, in the same manner as the first two lace ruffles. The bottom edge of the third lace ruffle 60 will extend below the lower edge of the roof sections 36 and 38.

In each case the dense stripe 64 of lace is laid along the glue bead line. As laid down in this manner, the pieces of lace will overlap, and the topmost piece of lace will extend about ¼–½" above the roof peak. The bottom piece of lace (53" long) will extend below the top edges of openings 26*a*–26*d*.

Finally, the platform 50 is covered with four pieces of lace, each 15" long. First, four pieces of lace having this length are cut. Then, beads of hot melt adhesive are laid down along lines 98*a*, 98*b*, 98*c* and 98*d* in that order. All four bead lines are parallel to slot 52, which is along the longitudinal center line of the platform. The first two bead lines 98*a*, 98*b* are about ¾" from the center line of the slot (or about ½" from the edge of the slot, assuming the slot is about ½" wide) and the two remaining bead lines 98*c*, 98*d* are about 3" from bead lines 98*a*, 98*c*, respectively. Again, the pieces of lace are applied so that the closely woven stripe 64 is laid along the bead line. The two pieces of lace closest to the slot overlap each other, the two remaining pieces of lace overlap the first two respective pieces of lace and also extend beyond the edge of the platform. The portions of lace which overlie the slot 52 are then cut away so that the slot is unobstructed. The lace-covered platform 50 is placed on the ledge-forming flaps 28*a*–28*d*, of the lace-covered wishing well 80.

Various modifications may be made without departing from the scope and spirit of this invention. For example, it is possible to form roof sections 36, 38 from a second blank rather than from portions of blank 20 as shown, although the illustrated construction is preferred. According to a further modification, the gift receptacle 80 may have a flat top or roof, in which case the roof is formed either by a pair of overlapping rectangular sections or flaps attached to panels 24*a* and 24*c*, respectively, or by a single section or flap attached to either panel 24*a* or 24*c*. Panels 24*b* and 24*d* are rectangular in shape and preferably provided with fold-down flaps along their top edges when a flat roof is used. A pitched roof as illustrated is preferred for aesthetic reasons.

While this invention has been described with reference to specific embodiments thereof, is shall be understood that the invention shall not be limited thereto or thereby, but that these embodiments have been described by way of illustration and not limitation.

What is claimed is:

1. A kit for assembly into a decorated gift receptacle for festive occasions, said kit comprising;

(a) a flexible waterproof plastic container;

(b) a blank of sheet material having fold lines thereon, said blank when folded along said fold lines forming a gift receptacle of rectangular cross sectional shape comprising a rectangular bottom, four vertical sides and a roof having a pair of sloping sections which intersect each other along a horizontal peak, said four sides comprising a first pair of opposite sides of rectangular shape and a second pair of opposite five-sided sides having gabled top ends, at least one of the four sides having an opening in the upper portion thereof;

(c) a rectangular sheet having a slot for the deposit of money, checks, greeting cards and the like, said rectangular sheet forming a horizontal platform for said receptacle; and (d) decorative trim in strip form attachable to the exterior surfaces of said blank as folded.

2. A kit according to claim 1 wherein said fold lines divide said blank into a plurality of sections including 4 panels in side-by-side relationship which form the vertical sides of said gift receptacle.

3. A kit according to claim 2 in which each of the four panels forming a vertical side of said gift receptacle include a cutout in the upper portion thereof, each of said cutouts having a pair of spaced vertical sides which are adjacent to but spaced from the adjacent edges of said panels, the edges of said panels being formed by said fold lines and by left and right edges of said blank, said blank also having turn down flaps providing supporting ledges for rectangular sheet.

4. A kit according to claim 2 wherein the sections of said blank further includes a plurality of flaps formed by fold lines, said flaps including a plurality of flaps forming said bottom flap means for joining together a pair of side-forming panels which are non-contiguous when said blank is flat and are adjacent when said blank is folded, and a flap for joining together the sections forming the top.

5. A kit according to claim 1 wherein said decorative trim is lace.

6. A kit according to claim 5 wherein said lace is in the form of a single strip of sufficient length to cover the entire exterior surface of the gift receptacle when assembled and is adapted to be cut into lengths during assembly.

7. A kit according to claim 6 wherein said lace is stretch lace.

8. A decorated gift receptacle comprising:

a bottom, four upright sides, and a roof formed of stiff sheet material which is foldable along fold lines therein, said gift receptacle being of rectangular cross-section and said four upright sides including one pair of opposite sides of rectangular shape and one pair of opposite side of five-sided shape, said roof comprising a pair of intersecting sloping sections, at least one of said sides having an opening in the upper portion thereof;

a horizontal slotted platform disposed below said opening; said bottom, said platform and the lower portions of said sides enclosing a space for receiving envelopes, checks, money and the like; and a plurality of overlapping strips of flexible decorative material affixed to the exterior surfaces of said sides below said opening, said strips being arranged in overlapping, vertically displaced rows, each said strip extending horizontally around the entire perimeter of said gift receptacle.

9. A gift receptacle according to claim 8 wherein said roof comprises a pair of intersecting sloping sections, each of said sides has an opening in the upper portion thereof, and said gift receptacle resembles a wishing well in appearance.

10. A gift receptacle according to claim 8 wherein said bottom, said sides and said roof are formed from a single piece blank of said stiff sheet material.

11. A gift receptacle according to claim 8 wherein said stiff sheet is corrugated cardboard.

12. A gift receptacle according to claim 8 wherein said decorative material is lace.

13. A gift receptacle according to claim 8 wherein said lace is stretch lace.

14. A gift receptacle according to claim 8 wherein: each of said sides has an opening in the upper portion thereof and said gift receptacle resembles a wishing well, said decorative material is lace;

said lace covers substantially the entire exterior surface of said sides and said roof; and said lace is arranged in overlapping horizontal rows on the lower portions of said sides and on said roof.

15. A gift receptacle according to claim 14 wherein said lace comprises a longitudinally extending stripe of closely woven material and longitudinally extending ruffled lacy portions of unequal widths on opposite sides thereof, and wherein the strips of lace are adhesively affixed to the exterior surfaces of said sides and roof substantially along said stripes of closely woven material.

16. A gift receptacle according to claim 14, further including a second set of lace strips extending across said roof and the adjacent portions of said five-sided sides, said second set of lace strips being arranged in a plurality of overlapping horizontal rows.

* * * * *